US011047063B2

(12) United States Patent
Fujikata et al.

(10) Patent No.: US 11,047,063 B2
(45) Date of Patent: Jun. 29, 2021

(54) PLATING APPARATUS AND PLATING METHOD

(71) Applicant: EBARA CORPORATION, Tokyo (JP)

(72) Inventors: Jumpei Fujikata, Tokyo (JP); Masashi Shimoyama, Tokyo (JP); Yoichi Nakagawa, Tokyo (JP); Yoshitaka Mukaiyama, Tokyo (JP); Yoshio Minami, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 287 days.

(21) Appl. No.: 16/373,456

(22) Filed: Apr. 2, 2019

(65) Prior Publication Data

US 2019/0226114 A1 Jul. 25, 2019

Related U.S. Application Data

(62) Division of application No. 14/919,002, filed on Oct. 21, 2015, now Pat. No. 10,294,578.

(30) Foreign Application Priority Data

Nov. 20, 2014 (JP) ..... JP2014-235906

(51) Int. Cl.
*C25D 17/00* (2006.01)
*C25D 5/02* (2006.01)
(Continued)

(52) U.S. Cl.
CPC ..... *C25D 17/008* (2013.01); *C25D 5/022* (2013.01); *C25D 17/001* (2013.01); *C25D 17/06* (2013.01); *C25D 17/10* (2013.01)

(58) Field of Classification Search
None
See application file for complete search history.

(56) References Cited

U.S. PATENT DOCUMENTS 6,514,393 B1 * 2/2003 Contolini ..... C25D 7/12 204/297.01
2006/0049038 A1 * 3/2006 Griego ..... C25D 21/12 204/228.1

(Continued)

FOREIGN PATENT DOCUMENTS

JP 2004-225129 A 8/2004
JP 2005-029863 A 2/2005

(Continued)

OTHER PUBLICATIONS

European Patent Application No. 15195214.0; Extended Search Report; dated May 9, 2016; 9 pages.

*Primary Examiner* — Louis J Rufo
(74) *Attorney, Agent, or Firm* — BakerHostetler

(57) ABSTRACT

A plating apparatus according to the present disclosure includes an anode holder configured to hold an anode; a substrate holder placed opposite the anode holder and configured to hold a substrate; and an anode mask installed on a front face of the anode holder and provided with a first opening adapted to allow passage of an electric current flowing between an anode and the substrate. The diameter of the first opening in the anode mask is configured to be adjustable. When a first substrate is plated, a diameter of the first opening is adjusted to a first diameter. When a second substrate is plated, the diameter of the first opening is adjusted to a second diameter smaller than the first diameter.

7 Claims, 5 Drawing Sheets

(51) Int. Cl.
*C25D 17/06* (2006.01)
*C25D 17/10* (2006.01)

(56) References Cited

U.S. PATENT DOCUMENTS

| | | | | |
|---|---|---|---|---|
| 2014/0166492 | A1 | 6/2014 | Shimoyama et al. | |
| 2014/0231245 | A1* | 8/2014 | Sandmann ..... | C25D 17/008<br>204/230.3 |

FOREIGN PATENT DOCUMENTS

| | | | | |
|---|---|---|---|---|
| JP | 2005029863 | A | * | 2/2005 |
| JP | 2014-118578 | A | | 6/2014 |
| TW | 201435147 | A | | 9/2014 |

* cited by examiner

FIG. 6

| | | AM | RP | PROFILE |
|---|---|---|---|---|
| (A) | HDP | 230 | 276 | |
| (B) | HDP | 270 | 280 | |
| (C) | HDP | 270 | 276 | |
| (D) | LDP | 220 | 274 | |
| (E) | LDP | 270 | 276 | |
| (F) | LDP | 220 | 276 | |

FIG. 7

| | | AM | RP | PROFILE |
|---|---|---|---|---|
| (A) | THICK SEED | 230 | 276 | |
| (B) | THICK SEED | 270 | 278 | |
| (C) | THICK SEED | 270 | 276 | |
| (D) | THIN SEED | 220 | 274 | |
| (E) | THIN SEED | 270 | 276 | |
| (F) | THIN SEED | 220 | 276 | |

FIG. 8

| | | AM | RP | PROFILE |
|---|---|---|---|---|
| (A) | PLATING SOLUTION TYPE A (HIGH RESISTANCE) | 230 | 276 | |
| (B) | PLATING SOLUTION TYPE A (HIGH RESISTANCE) | 260 | 272 | |
| (C) | PLATING SOLUTION TYPE A (HIGH RESISTANCE) | 260 | 276 | |
| (D) | PLATING SOLUTION TYPE B (LOW RESISTANCE) | 220 | 274 | |
| (E) | PLATING SOLUTION TYPE B (LOW RESISTANCE) | 270 | 276 | |
| (F) | PLATING SOLUTION TYPE B (LOW RESISTANCE) | 220 | 276 | |

PLATING APPARATUS AND PLATING METHOD

CROSS-REFERENCE TO RELATED APPLICATION

This application is a divisional of U.S. application Ser. No. 14/919,002, filed Oct. 21, 2015, which claims priority to and benefit of Japanese Patent Application No. 2014-235906 filed Nov. 20, 2014, the entire contents of which are incorporated herein by reference.

TECHNICAL FIELD

The present invention relates to a plating apparatus and plating method for plating substrates such as semiconductor wafers.

BACKGROUND ART

Conventionally, wiring is formed in minute wiring grooves, holes, or resist openings provided on surfaces of substrates such as semiconductor wafers or bumps (bumpy electrodes) used to electrically connect to electrodes of a package which are formed on the surfaces of the substrates. As a method for forming the wiring and bumps, an electrolytic plating process, vacuum deposition process, printing process, ball bumping process, and the like are known, for example. With increases in I/O counts and pitch refinement on semiconductor chips, the electrolytic plating process which allows refinement and shows comparatively stable performance has come to be used frequently.

When wiring or bumps are formed by the electrolytic plating process, a seed layer (feeder layer) with low electrical resistance is formed on surfaces of barrier metal provided in the wiring grooves, holes, or resist openings in the substrates. A plating film grows on a surface of the seed layer. In recent years, seed layers with thinner film thickness have come to be used along with refinement of wiring and bumps. With decreases in the film thickness of the seed layer, the electrical resistance (sheet resistance) of the seed layer increases.

Generally, a substrate to be plated has an electrical contact on its periphery. Consequently, an electric current corresponding to combined resistance of an electrical resistance value of the plating solution and electrical resistance value of the seed layer between a central portion of the substrate and the electrical contact flows through the central portion of the substrate. On the other hand, an electric current almost corresponding to the electrical resistance value of the plating solution flows through the periphery (near the electrical contact) of the substrate. That is, the flow of the electric current to the central portion of the substrate is resisted to an extent corresponding to the electrical resistance value of the seed layer between the central portion of the substrate and the electrical contact. The phenomenon in which electric current concentrates on the periphery of a substrate is referred to as a terminal effect.

In the case of a substrate which has a seed layer comparatively thin in film thickness, the electrical resistance value of the seed layer between the central portion of the substrate and the electrical contact is comparatively high. Therefore, in plating a substrate whose seed layer is comparatively thin in film thickness, the terminal effect is prominent. Consequently, the plating rate in the central portion of the substrate falls, making the plating film in the central portion of the substrate thinner in film thickness than the plating film in the periphery of the substrate and resulting in reduced in-plane uniformity of film thickness.

In order to curb the reduction in the in-plane uniformity of film thickness due to the terminal effect, it is necessary to adjust an electric field applied to the substrate. For example, a plating apparatus is known, in which an anode regulation plate is installed on a front face of an anode to regulate a potential distribution on an anode surface (see Japanese Patent Laid-Open No. 2005-029863).

Now, the influence of the terminal effect varies with the degree of film thickness of the seed layer on the substrate. Specifically, as described above, when the seed layer is comparatively thin in film thickness, since the sheet resistance is comparatively high, the influence of the terminal effect appears prominently. On the other hand, when the seed layer is comparatively thick in film thickness, since the sheet resistance is comparatively low, the influence of the terminal effect is comparatively small.

Also, the influence of the terminal effect can vary not only with the degree of film thickness of the seed layer, but also with the other factors. For example, when a resist aperture ratio of the substrate is comparatively high, the plating film formed on the substrate has a comparatively large area, where the resist aperture ratio is the area ratio of a portion not covered with resist (open portion of the resist) to a region bordered by an outer edge of the resist. Therefore, as the plating film is formed on the substrate, the formed plating film causes electric current to flow readily in the central portion of the substrate as well. In other words, as the plating film is formed on the substrate, the electrical resistance value between the central portion of the substrate and the electrical contact decreases, gradually reducing the influence of the terminal effect. On the other hand, when the resist aperture ratio of the substrate is comparatively low, the area of the plating film formed on the substrate is relatively small. Consequently, when the resist aperture ratio of the substrate is comparatively low, even if a plating film is formed on the substrate, variation in the electrical resistance value between the central portion of the substrate and the electrical contact is smaller than when the resist aperture ratio of the substrate is comparatively high, and thus the influence of the terminal effect remains large.

Also, when the electrical resistance value of a plating solution used to process the substrate is comparatively high, the influence of the terminal effect is smaller than when the electrical resistance value of the plating solution used to process the substrate is comparatively low. Specifically, if the electrical resistance value of the plating solution is R1 and the electrical resistance value of the seed layer between the central portion of the substrate and the electrical contact is R2, an electric current corresponding to combined resistance value (R1+R2) flows through the central portion of the substrate. On the other hand, an electric current almost corresponding to the electrical resistance value R1 of the plating solution flows through the periphery (near the electrical contact) of the substrate. Thus, as the electrical resistance value R1 increases, the influence of the electrical resistance value R2 to the electric current flowing through the central portion of the substrate decreases, reducing the influence of the terminal effect.

In this way, the influence of the terminal effect varies with characteristics of the substrate, conditions for processing the substrate, and the like. Therefore, when plural substrates differing in the influence of the terminal effect are plated using a single plating apparatus, in order to curb the reduction in the in-plane uniformity of film thickness due to the terminal effect, it is necessary to adjust the electric fields applied to the substrates, according to the characteristics of the respective substrates, conditions for processing the substrates, and the like. However, in order to adjust the electric fields according to the characteristics of the substrates, conditions for processing the substrates, and the like using an anode regulation plate such as described in Japanese Patent Laid-Open No. 2005-029863, it is necessary to prepare plural anode regulation plates which suit the characteristics of the substrates, conditions for processing the substrates, and the like.

Besides, even if plural anode regulation plates are prepared, each time substrates differing in characteristics and processing conditions are processed, it is necessary to take the anode regulation plate out of the plating bath and install another anode regulation plate, involving time and effort.

SUMMARY OF INVENTION

The present invention has been made in view of the above problems and has an object to provide a plating apparatus and plating method which can curb reduction in in-plane uniformity due to influence of a terminal effect in processing plural substrates differing in characteristics and processing conditions.

Also, another object of the present invention is to provide a plating apparatus and plating method which can curb the reduction in in-plane uniformity due to the influence of the terminal effect in processing plural substrates differing in a resist aperture ratio.

Also, still another object of the present invention is to provide a plating apparatus and plating method which can curb the reduction in in-plane uniformity due to the influence of the terminal effect in processing plural substrates differing in thickness of a seed layer.

Also, yet another object of the present invention is to provide a plating apparatus and plating method which can curb the reduction in in-plane uniformity due to the influence of the terminal effect in processing plural substrates in different respective plating solutions.

The present invention has been made to achieve at least one of the above-mentioned objects and can be implemented, for example, in the following forms.

A first form of the present invention is a plating apparatus comprising: an anode holder configured to hold an anode; a substrate holder placed opposite the anode holder and configured to hold a substrate; an anode mask mounted integrally on the anode holder and provided with a first opening adapted to allow passage of an electric current flowing between the anode and the substrate; and a regulation plate installed between the anode mask and the substrate holder and provided with a second opening adapted to allow passage of the electric current flowing between the anode and the substrate, wherein the anode mask includes a first adjustment mechanism adapted to adjust a diameter of the first opening.

The plating apparatus of the first form can adjust the diameter of the first opening of the anode mask for each of a first substrate and second substrate. This makes it possible to curb reduction in in-plane uniformity due to influence of a terminal effect when the first substrate and second substrate differ from each other in characteristics or processing conditions. Specifically, when the second substrate is plated under conditions in which the influence of the terminal effect appears prominently, by reducing the diameter of the first opening, it is possible to concentrate an electric field on a central portion of the substrate and thereby increase film thickness in the central portion of the substrate.

According to a second form of the present invention, in the first form, the regulation plate includes a second adjustment mechanism adapted to adjust a diameter of the second opening. The regulation plate is placed at a position closer to the substrate holder than to the anode mask. If the diameter of the second opening in the regulation plate is reduced, a film deposition rate on a periphery of the substrate can be slowed down. Thus, by adjusting the diameter of the second opening in the regulation plate, it is possible to improve the in-plane uniformity on the substrate W.

According to a third form of the present invention, in the second form, the second adjustment mechanism is an elastic body installed along the second opening; and the diameter of the second opening is adjusted by injecting a fluid into the elastic body or by discharging the fluid out of the elastic body. The third form allows the diameter of the second opening to be adjusted using a simple configuration without using a mechanical structure.

A fourth form of the present invention is a plating method comprising: placing an anode holder in a plating bath, where the anode holder is integrally provided with an anode mask having a first opening adapted to allow passage of an electric current flowing between an anode and a substrate; placing a substrate holder adapted to hold a first substrate in the plating bath; placing a regulation plate between the anode mask and the substrate, where the regulation plate includes a second opening adapted to allow passage of the electric current flowing between the anode and the substrate; plating the first substrate with a diameter of the first opening adjusted to a first diameter; placing a substrate holder adapted to hold a second substrate in the plating bath; and plating the second substrate with a diameter of the first opening adjusted to a second diameter smaller than the first diameter.

The fourth form allows the diameter of the first opening of the anode mask to be adjusted for each of the first substrate and second substrate. This makes it possible to curb the reduction in in-plane uniformity due to the influence of the terminal effect when the first substrate and second substrate differ from each other in characteristics or processing conditions. Specifically, when the second substrate is plated under conditions in which the influence of the terminal effect appears prominently, by reducing the diameter of the first opening, it is possible to concentrate an electric field on a central portion of the substrate and thereby increase film thickness in the central portion of the substrate.

According to a fifth form of the present invention, in the fourth form, the first substrate and the second substrate are partially covered with resist; and a resist aperture ratio of the second substrate is lower than a resist aperture ratio of the first substrate. That is, according to the fifth form, the second substrate having a relatively low resist aperture ratio can be plated with the diameter of the first opening of the anode mask being adjusted to the second diameter. This makes it possible to increase the film thickness in the central portion of the second substrate on which the influence of the terminal effect is less prone to change (remains large) even when plating progresses. Consequently, the reduction in in-plane uniformity due to the influence of the terminal effect can be curbed.

According to a sixth form of the present invention, in the fourth form, a seed layer of the second substrate is thinner than a seed layer of the first substrate. That is, according to the sixth form, the second substrate which has a relatively thin seed layer can be plated with the diameter of the first opening of the anode mask being adjusted to the relatively small second diameter. This makes it possible to increase the film thickness in the central portion of the second substrate on which the influence of the terminal effect appears relatively prominently. Consequently, the reduction in in-plane uniformity due to the influence of the terminal effect can be curbed.

According to a seventh form of the present invention, in the fourth form, a plating solution used in the step of plating the second substrate is lower in electrical resistance than a plating solution used in the step of plating the first substrate. That is, according to the seventh form, the second substrate plated in a plating solution relatively low in electrical resistance can be plated with the diameter of the first opening of the anode mask being adjusted to the relatively small second diameter. This makes it possible to increase the film thickness in the central portion of the second substrate on which the influence of the terminal effect appears relatively prominently. Consequently, the reduction in in-plane uniformity due to the influence of the terminal effect can be curbed.

According to the eighth form of the present invention, in any one of the fourth to seventh forms, the plating method further comprises adjusting the diameter of the second opening in the regulation plate. According to the eighth form, the regulation plate is placed at a position closer to the substrate holder than to the anode mask. If the diameter of the second opening in the regulation plate is reduced, the film deposition rate on the periphery of the substrate can be slowed down. Thus, by adjusting the diameter of the second opening in the regulation plate, it is possible to improve the in-plane uniformity on the substrate W.

According to a ninth form of the present invention, in the eighth form, the regulation plate includes an elastic body installed along the second opening; and the step of adjusting the diameter of the second opening in the regulation plate includes a step of injecting a fluid into the elastic body or discharging the fluid out of the elastic body. The ninth form allows the diameter of the second opening to be adjusted using a simple configuration without using a mechanical structure.

BRIEF DESCRIPTION OF DRAWINGS

FIG. 6 is a diagram showing profiles of plating films for substrates with a high resist aperture ratio and substrates with a low resist aperture ratio;

FIG.7 is a diagram showing profiles of plating films for substrates with a thick seed layer and substrates with a thin seed layer; and FIG. 8 is a diagram showing profiles of plating films on substrates plated in a plating solution having a comparatively high electrical resistance and substrates plated in a plating solution having a comparatively low electrical resistance.

DESCRIPTION OF EMBODIMENTS

Figure 1:
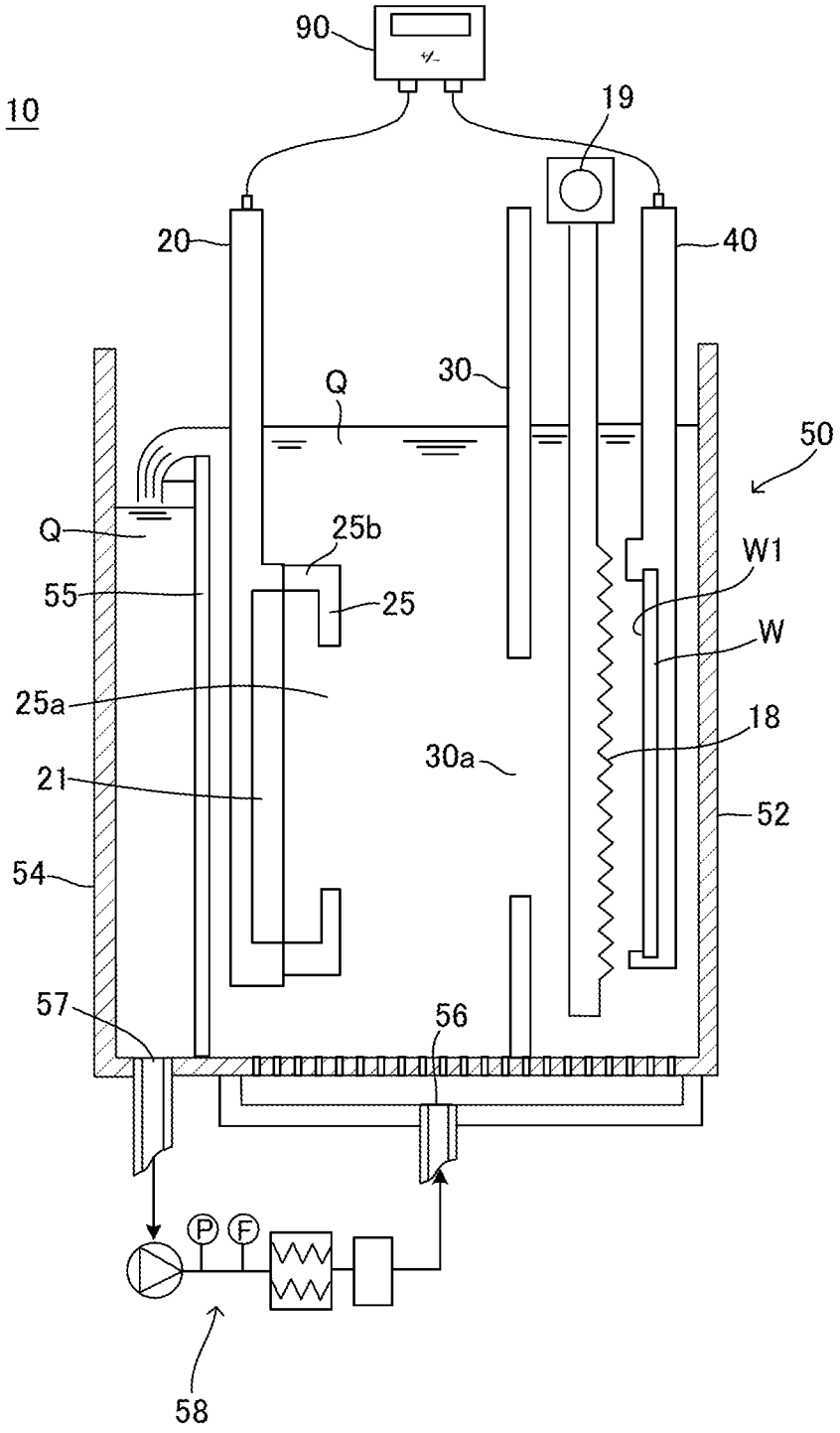
FIG. 1 is a schematic sectional side view of a plating apparatus according to an embodiment of the present invention.

An embodiment of the present invention will be described below with reference to the drawings. In the drawings described below, same or equivalent components are denoted by the same reference numerals, and redundant description thereof will be omitted.

FIG. 1 is a schematic sectional side view of a plating apparatus according to an embodiment of the present invention. As illustrated in FIG. 1, the plating apparatus 10 according to the present embodiment includes an anode holder 20 configured to hold an anode 21, a substrate holder 40 configured to hold a substrate W, and a plating bath 50 adapted to hold the anode holder 20 and substrate holder 40 therein.

As shown in FIG. 1, the plating bath 50 includes a plating treatment bath 52 adapted to hold a plating solution Q containing additives, a plating solution discharge bath 54 adapted to receive and discharge the plating solution Q overflowing from the plating treatment bath 52, and a partition wall 55 adapted to separate the plating treatment bath 52 and plating solution discharge bath 54.

The anode holder 20 holding the anode 21 and substrate holder 40 holding the substrate W are immersed in the plating solution Q in the plating treatment bath 52 and installed there facing each other such that the anode 21 and a surface-to-be-plated W1 of the substrate W will be substantially parallel to each other. A voltage is applied by a plating power supply 90 to the anode 21 and substrate W immersed in the plating solution Q in the plating treatment bath 52. Consequently, the metal ions are reduced on the surface-to-be-plated W1 of the substrate W, forming a film on the surface-to-be-plated W1.

The plating treatment bath 52 has a plating solution supply port 56 for use to supply the plating solution Q into the bath. The plating solution discharge bath 54 has a plating solution discharge port 57 for use to discharge the plating solution Q overflowing from the plating treatment bath 52. The plating solution supply port 56 is located at a bottom of the plating treatment bath 52 while the plating solution discharge port 57 is located at a bottom of the plating solution discharge bath 54.

When supplied to the plating treatment bath 52 through the plating solution supply port 56, the plating solution Q overflows from the plating treatment bath 52, gets over the partition wall 55, and flows into the plating solution discharge bath 54. After flowing into the plating solution discharge bath 54, the plating solution Q is discharged through the plating solution discharge port 57, and impurities are removed by a filter and the like of a plating solution circulation unit 58. The plating solution Q with the impurities removed therefrom is supplied to the plating treatment bath 52 through the plating solution supply port 56 by the plating solution circulation unit 58.

The anode holder 20 includes an anode mask 25 adapted to adjust an electric field between the anode 21 and substrate W. The anode mask 25 is a substantially plate-like member made, for example, of a dielectric material and is installed on a front face of the anode holder 20. The front face of the anode holder 20 here is a face on the side facing the substrate holder 40. That is, the anode mask 25 is placed between the anode 21 and substrate holder 40. The anode mask 25 has a first opening 25*a* in an approximate central portion thereof, where an electric current flowing between the anode 21 and substrate W passes through the first opening 25*a*. Preferably the first opening 25*a* is smaller in diameter than the anode 21. As described later, the diameter of the first opening 25*a* in the anode mask 25 is configured to be adjustable.

The anode mask 25 has an anode mask mount 25b on its outer circumference to mount the anode mask 25 integrally on the anode holder 20. Note that the position of the anode mask 25 can be between the anode holder 20 and substrate holder 40, but preferably the anode mask 25 is closer to the anode holder 20 than the intermediate position between the anode holder 20 and substrate holder 40. Also, for example, the anode mask 25 may be placed on the front face of the anode holder 20 without being mounted on the anode holder 20. However, when the anode mask 25 is attached to the anode holder 20 as with the present embodiment, the position of the anode mask 25 relative to the anode holder 20 is fixed, making it possible to prevent displacement between the position of the anode 21 held by the anode holder 20 and position of the first opening 25*a* in the anode mask 25.

Preferably the anode 21 held by the anode holder 20 is an insoluble anode. When the anode 21 is an insoluble anode, the anode 21 does not dissolve even when the plating process progresses, and the shape of the anode 21 remains unchanged. Consequently, since the positional relationship (distance) between the anode mask 25 and anode 21 does not change, it is possible to prevent changes in the electric field between the anode 21 and substrate W, which would be caused by changes in the positional relationship between the anode mask 25 and a surface of anode 21.

The plating apparatus 10 further includes a regulation plate 30 adapted to adjust the electric field between the anode 21 and substrate W. The regulation plate 30 is a substantially flat-plate member made, for example, of a dielectric material and is installed between the anode mask 25 and substrate holder 40 (substrate W). The regulation plate 30 includes a second opening 30*a* adapted to allow passage of the electric current flowing between the anode 21 and substrate W. Preferably the second opening 30*a* is smaller in diameter than the substrate W. As described later, the diameter of the second opening 30*a* in the regulation plate 30 is configured to be adjustable.

Preferably the regulation plate 30 is closer to the substrate holder 40 than the intermediate position between the anode holder 20 and substrate holder 40. The closer to the substrate holder 40 the regulation plate 30 is placed, the more accurately the film thickness on the periphery of the substrate W can be controlled by adjusting the diameter of the second opening 30*a* in the regulation plate 30.

A paddle 18 is installed between the regulation plate 30 and substrate holder 40 to stir the plating solution Q near the surface-to-be-plated W1 of the substrate W. The paddle 18 is a substantially rod-shaped member and is installed in the plating treatment bath 52, extending in a vertical direction. One end of the paddle 18 is fixed to a paddle drive unit 19. The paddle 18 is moved by the paddle drive unit 19 horizontally along the surface-to-be-plated W1 of the substrate W, thereby stirring the plating solution Q.

Figure 2:
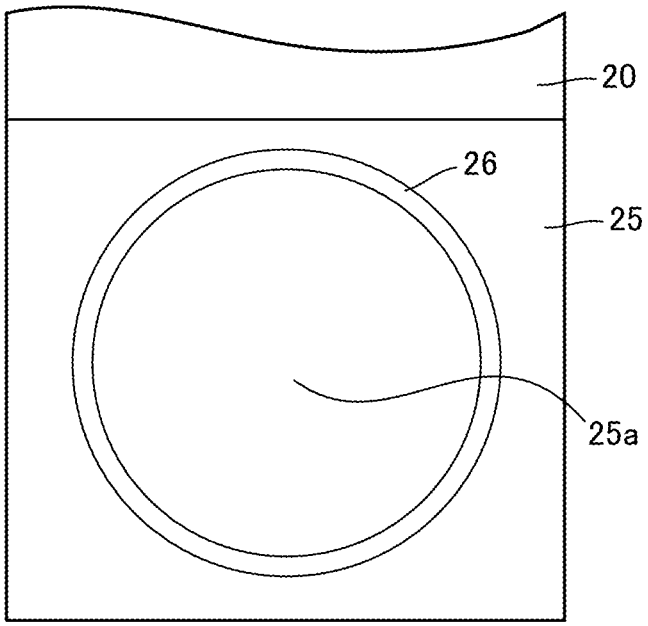
FIG. 2 is a schematic front view of an anode mask.
Figure 3:
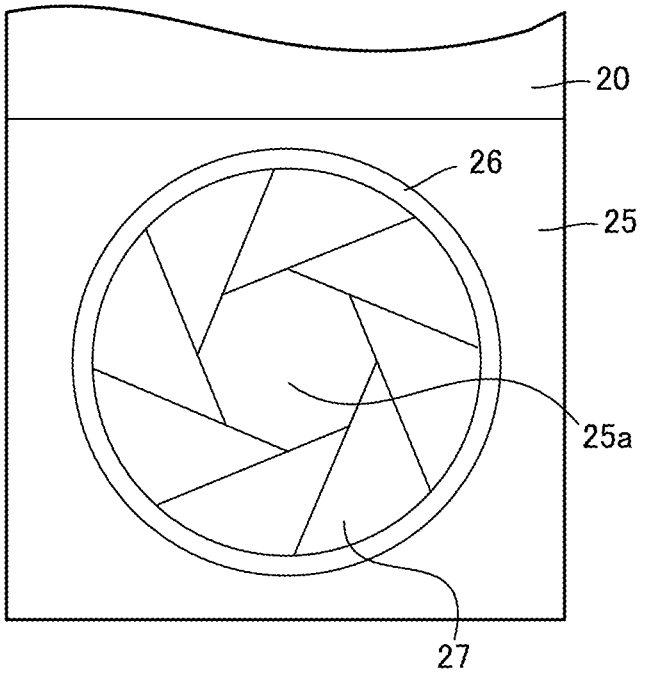
FIG. 3 is a schematic front view of the anode mask.

Next, the anode mask 25 shown in FIG. 1 will be described in detail. FIGS. 2 and 3 are schematic front views of the anode mask 25. FIG. 2 shows the anode mask 25 when the diameter of the first opening 25*a* is comparatively large. FIG. 3 shows the anode mask 25 when the diameter of the first opening 25*a* is comparatively small. Here, the smaller the first opening 25*a* in the anode mask 25, the more heavily the electric current flowing from the anode 21 to the substrate W is concentrated on the central portion of the surface-to-be-plated W1 of the substrate W. Thus, as the first opening 25*a* is reduced in size, the film thickness in the central portion of the surface-to-be-plated W1 of the substrate W tends to increase.

As shown in FIG. 2, the anode mask 25 has a rim 26 substantially annular in shape. In FIG. 2, the diameter size of the first opening 25*a* in the anode mask 25 is maximized. In this case, the diameter of the first opening 25*a* coincides with the inside diameter of the rim 26.

As shown in FIG. 3, the anode mask 25 includes plural aperture blades 27 (first adjustment mechanism) configured to be able to adjust the first opening 25*a*. The aperture blades 27 define the first opening 25*a* in collaboration with one another. Being structured similarly to an aperture mechanism of a camera, the aperture blades 27 together increase and decrease the diameter of the first opening 25*a* (adjust the diameter of first opening 25*a*). The first opening 25*a* in the anode mask 25 shown in FIG. 3 is formed into a non-circular shape (e.g., polygonal shape) by means of the aperture blades 27. In this case, the diameter of the first opening 25*a* corresponds to the shortest distance between opposite sides of the polygon or the diameter of an inscribed circle. Alternatively, the diameter of the first opening 25*a* can be defined by the diameter of a circle having an area equivalent to the area of the opening. Note that the distance between anode 21 and that face of the aperture blade 27 which faces the anode 21 is, for example, approximately between 8 mm and 0 mm (both inclusive).

The aperture blades 27 are used in conjunction, for example, to manually increase and decrease the diameter of the first opening 25*a*. Also, the aperture blades 27 may be configured to be driven together by means of pneumatic pressure or an electric driving force. The first adjustment mechanism which uses the aperture blades 27 features the capability to make the first opening 25*a* variable in a comparatively wide range. Also, when the substrate is circular, desirably the first opening 25*a* in the anode mask 25 is circular. However, it is mechanically difficult to maintain a completely circular shape in an entire range of the opening 25*a* from minimum diameter to maximum diameter. Generally, when the opening adapted to allow the passage of the electric current flowing between the anode 21 and substrate W is not completely circular, the electric field becomes azimuthally nonuniform and consequently the shape of the opening may be transferred to a thickness distribution of a plating film formed on the periphery of the substrate W. However, since the anode mask 25 is mounted integrally on the anode holder 20, allowing a sufficient distance from the substrate, the influence on the plating film thickness distribution can be minimized even when the opening is not completely circular.

Figure 4A:
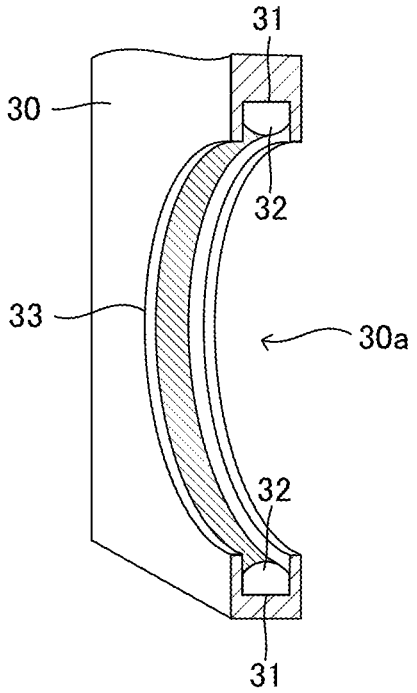
FIG. 4A is a diagram showing a regulation plate, of which diameter of a second opening is comparatively large.
Figure 4B:
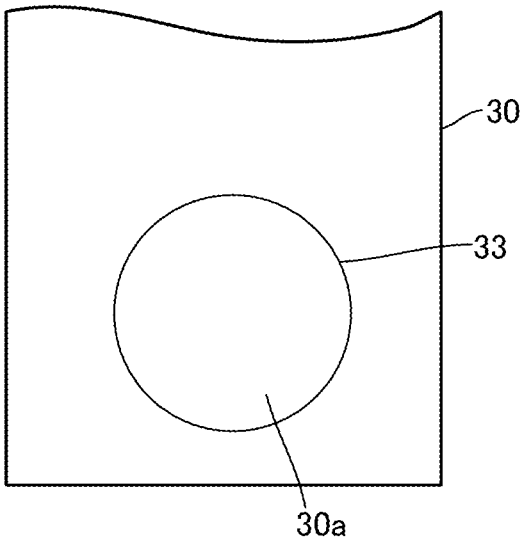
FIG. 4B is a diagram showing the regulation plate, of which the diameter of the second opening is comparatively large.
Figure 5A:
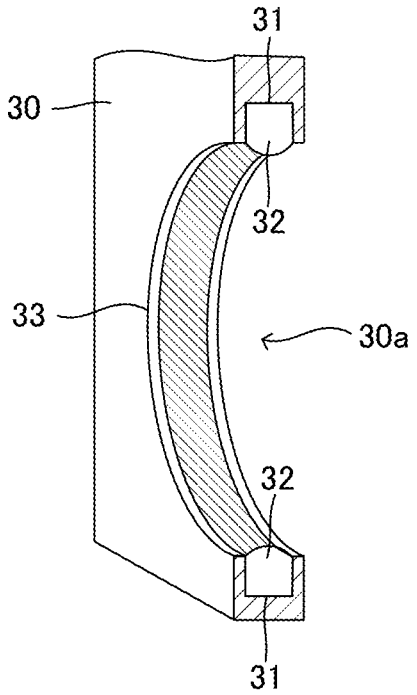
FIG. 5A is a diagram showing the regulation plate, of which diameter of the second opening is comparatively small.
Figure 5B:
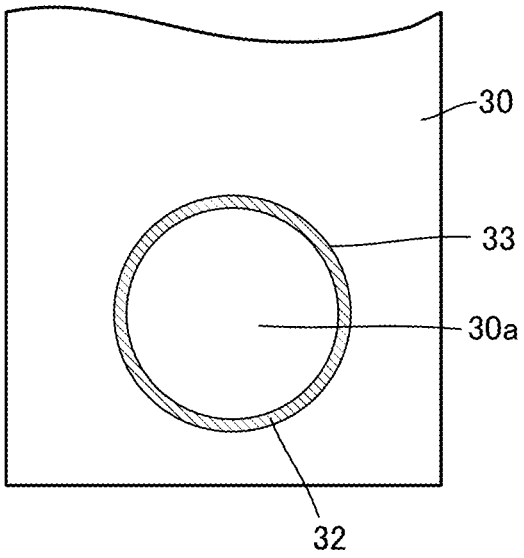
FIG. 5B is a diagram showing the regulation plate, of which the diameter of the second opening is comparatively small.

Next, the regulation plate 30 shown in FIG. 1 will be described in detail. FIGS. 4A and 4B show the regulation plate 30, of which the diameter of the second opening 30*a* is comparatively large while FIGS. 5A and 5B show the regulation plate 30, of which the diameter of the second opening 30*a* is comparatively small. FIG. 4A is a partial sectional side view of the regulation plate 30 and FIG. 4B is a plan view of the regulation plate 30. FIG. 5A is a partial sectional side view of the regulation plate 30 and FIG. 5B is a plan view of the regulation plate 30.

As shown in FIGS. 4A and 4B, the regulation plate 30 has a rim 33 substantially annular in shape and a groove 31 running along the second opening 30*a*. Also, the regulation plate 30 includes an elastic tube 32 (second adjustment mechanism; elastic body) configured to be able to adjust the diameter of the second opening 30*a*. Specifically, the elastic tube 32 is installed along the second opening 30*a*, and placed in the groove 31 with an outer circumferential portion of the elastic tube 32 being fixed to the groove 31. The elastic tube 32 is formed, for example, of an elastic material such as a resin and is substantially annular in shape. The elastic tube 32 has a cavity in its interior and is configured to be able to hold a fluid (a gas such as air or nitrogen or a fluid such as water). The elastic tube 32 has an injection port (not shown) for use to inject the fluid into the elastic tube 32, and a discharge port (not shown) for use to discharge the fluid out of the elastic tube 32.

In the regulation plate 30 shown in FIGS. 4A and 4B, the elastic tube 32 is in a contracted state, containing a comparatively small amount of fluid. Consequently, as shown in FIG. 4B, the diameter of the second opening 30*a* in the regulation plate 30 coincides with the inside diameter of the rim 33.

Since the outer circumference of the elastic tube 32 is in contact with the groove 31, when a fluid is injected into the elastic tube 32, the elastic tube 32 expands inward in a radial direction as shown in FIGS. 5A and 5B. As the elastic tube 32 expands inward in the radial direction, the inside diameter of the elastic tube 32 matches the diameter of the second opening 30*a* as shown in FIG. 5B.

On the other hand, in the state shown in FIGS. 5A and 5B, in which the elastic tube 32 is expanded, when the fluid in the elastic tube 32 is discharged, the elastic tube 32 contracts as shown in FIGS. 4A and 4B. Thus, as the fluid is injected into the elastic tube 32 or discharged out of the elastic tube 32, the elastic tube 32 adjusts the diameter of the second opening 30*a*. The elastic tube 32 allows the diameter of the second opening to be adjusted using a simple configuration without using a mechanical structure.

In comparison to the first adjustment mechanism which uses the aperture blades 27, the second adjustment mechanism, which involves adjusting the internal pressure of the elastic body, can vary the diameter of the opening while keeping the shape of the opening circular. This makes it possible to form a uniform plating film on the periphery of the substrate by installing the regulation plate 30 between the anode mask 25 and substrate even if an azimuthally nonuniform electric field is formed between the anode mask 25 and regulation plate 30.

Next, description will be given of the process of plating the substrate W using the plating apparatus 10 shown in FIG. 1. As described above, the influence of the terminal effect varies with characteristics of the substrate W, conditions for processing the substrate W, and the like. Therefore, when plural substrates W differing in the influence of the terminal effect are plated using a single plating apparatus 10, in order to curb the reduction in the in-plane uniformity of film thickness due to the terminal effect, it is necessary to adjust the electric field applied to each substrate W, according to the characteristics of the substrate W, conditions for processing the substrate W, and the like.

By adjusting the diameter of at least the first opening 25*a* in the anode mask 25 according to the characteristics of the substrates W or conditions for processing the substrates W, the plating apparatus 10 of the present embodiment can curb the reduction in the in-plane uniformity of the plating film on the substrates W.

Specifically, when the resist aperture ratio of the second substrate is lower than the resist aperture ratio of the first substrate, as described above, even if a plating film is formed on the second substrate, variation in the electrical resistance value between the central portion of the second substrate and the electrical contact is smaller than in the case of the first substrate whose resist aperture ratio is comparatively high. Consequently, even if a plating film is formed to some extent on the second substrate, the influence of the terminal effect on the second substrate remains large. Therefore, when the first substrate and second substrate are plated by keeping the conditions other than the resist aperture ratios of the substrates equal, the film thickness of the second substrate becomes larger in a peripheral portion of the substrate and relatively smaller in the central portion the substrate than the film thickness of the first substrate. Thus, the diameter of the first opening 25*a* in the anode mask 25 is set smaller when the second substrate is plated using the plating apparatus 10 than when the first substrate is plated. This makes it possible to increase the film thickness in the central portion of the second substrate. Consequently, the reduction in in-plane uniformity due to the influence of the terminal effect can be curbed on both the first substrate and second substrate.

Also, when a seed layer of the second substrate is thinner than a seed layer of the first substrate, the terminal effect on the second substrate becomes prominent as described above. Therefore, when the first substrate and second substrate are plated by keeping the conditions other than the thickness of the seed layer equal, the film thickness of the second substrate becomes larger in the peripheral portion of the substrate and relatively smaller in the central portion the substrate than the film thickness of the first substrate. Thus, the diameter of the first opening 25*a* in the anode mask 25 is set smaller when the second substrate is plated using the plating apparatus 10 than when the first substrate is plated. This makes it possible to increase the film thickness in the central portion of the second substrate. Consequently, the reduction in in-plane uniformity due to the influence of the terminal effect can be curbed on both the first substrate and second substrate.

Furthermore, when the second substrate is plated using a plating solution with a lower electrical resistance value than the plating solution used for the first substrate, the terminal effect on the second substrate becomes prominent as described above. Therefore, when the first substrate and second substrate are plated by keeping the conditions other than the electrical resistance value equal, the film thickness of the second substrate becomes larger in the peripheral portion of the substrate and relatively smaller in the central portion the substrate than the film thickness of the first substrate. Thus, the diameter of the first opening 25*a* in the anode mask 25 is set smaller when the second substrate is plated using the plating apparatus 10 than when the first substrate is plated. This makes it possible to increase the film thickness in the central portion of the second substrate. Consequently, the reduction in in-plane uniformity due to the influence of the terminal effect can be curbed on both the first substrate and second substrate.

Furthermore, by adjusting the diameter of the second opening 30*a* in the regulation plate 30 in addition to adjusting the diameter of the first opening 25*a* in the anode mask 25, the plating apparatus 10 of the present embodiment can improve the in-plane uniformity of the plating film on the substrate W.

The regulation plate 30 is placed at a position closer to the substrate W than to the anode mask 25. Consequently, a plating current passing through the second opening 30*a* in the regulation plate 30 becomes less prone to spread to the periphery of the substrate W. Thus, if the diameter of the second opening 30*a* in the regulation plate 30 is decreased, the film thickness on the periphery of the substrate W can be decreased, and if the diameter of the second opening 30*a* in the regulation plate 30 is increased, the film thickness on the periphery of the substrate W can be increased.

Preferably the diameter of the second opening 30*a* in the regulation plate 30 is adjusted as appropriate according to the film thickness distribution on the substrate W, which is changed by adjusting the diameter of the first opening 25*a* in the anode mask 25.

Next, a concrete description will be given of changes in profiles of plating films on substrates W, where the profiles are changed by changing the diameter of the first opening 25*a* in the anode mask 25 and the diameter of the second opening 30*a* in the regulation plate 30.

FIG. 6 is a diagram showing profiles of plating films on substrates W with a high resist aperture ratio (80%) and substrates W with a low resist aperture ratio (10%). In FIG. 6, "AM" denotes the diameter of the first opening 25*a* in the anode mask 25, "RP" denotes the diameter of the second opening 30*a* in the regulation plate 30, HDP denotes a substrate W with a high resist aperture ratio, and LDP denotes a substrate W with a low resist aperture ratio. Note that both the substrates W with a high resist aperture ratio and substrates W with a low resist aperture ratio are 50 nm to 100 nm in seed layer thickness and that the profiles in FIG. 6 are obtained using a solution with a comparatively low resistance for plating.

As illustrated in FIG. 6, when the substrate W with a high resist aperture ratio is plated with the diameter of the first opening 25*a* set to 230 mm and with the diameter of the second opening 30*a* set to 276 mm (hereinafter this condition will be referred to as condition A), the film thickness in the central portion of the substrate is large and the film thicknesses on the periphery of the substrate is small. In contrast, when the substrate W with a high resist aperture ratio is plated with the diameter of the first opening 25*a* set to 270 mm and with the diameter of the second opening 30*a* set to 276 mm (hereinafter this condition will be referred to as condition C), since the diameter of the first opening 25*a* is larger under condition C than under condition A, the film thickness in the central portion of the substrate is smaller. Also, when the substrate W with a high resist aperture ratio is plated with the diameter of the first opening 25*a* set to 270 mm and with the diameter of the second opening 30*a* set to 280 mm (hereinafter this condition will be referred to as condition B), since the diameter of the second opening 30*a* is larger under condition B than under condition C, the film thicknesses on the periphery of the substrate is larger.

When the substrate W with a low resist aperture ratio is plated with the diameter of the first opening 25*a* set to 270 mm and with the diameter of the second opening 30*a* set to 276 mm (hereinafter this condition will be referred to as condition E), the film thickness in the central portion of the substrate is small and the film thicknesses on the periphery of the substrate is large. This means that the film thickness on the periphery of the substrate has been increased under the influence of the terminal effect. In contrast, when the substrate W with a low resist aperture ratio is plated with the diameter of the first opening 25*a* set to 220 mm and with the diameter of the second opening 30*a* set to 276 mm (hereinafter this condition will be referred to as condition F), since the diameter of the first opening 25*a* is smaller under condition F than under condition E, the film thickness in the central portion of the substrate is larger. Also, when the substrate W with a low resist aperture ratio is plated with the diameter of the first opening 25*a* set to 220 mm and with the diameter of the second opening 30*a* set to 274 mm (hereinafter this condition will be referred to as condition D), since the diameter of the second opening 30*a* is smaller under condition D than under condition F, the film thicknesses on the periphery of the substrate is smaller.

As shown in FIG. 6, even in the case of the substrates W with a low resist aperture ratio on which the influence of the terminal effect appears comparatively prominently, if the diameter of the first opening 25*a* is set smaller than the diameter (270 mm: conditions B and C) of the first opening 25*a* suitable for plating of the substrates W with a high resist aperture ratio, it is possible to curb the reduction in the in-plane uniformity of film thickness on the substrates W due to the terminal effect (see conditions D and F). Furthermore, by adjusting the diameter of the second opening 30*a* in the regulation plate 30, the film thickness on the periphery of the substrate W can be adjusted, making it possible to further curb the reduction in the in-plane uniformity of film thickness on the substrates W due to the terminal effect (see condition D).

FIG. 7 is a diagram showing profiles of plating films on substrates W with a thick seed layer (500 nm or above) and substrates W with a thin seed layer (50 to 100 nm). Note that both the substrates W with a thick seed layer and substrates W with a thin seed layer have a resist aperture ratio of 10% and that the profiles in FIG. 7 are obtained using a solution with a comparatively low resistance for plating.

As illustrated in FIG. 7, when the substrate W with a thick seed layer is plated with the diameter of the first opening 25*a* set to 230 mm and with the diameter of the second opening 30*a* set to 276 mm (hereinafter this condition will be referred to as condition A), the film thickness in the central portion of the substrate is large and the film thicknesses on the periphery of the substrate is small. In contrast, when the substrate W with a thick seed layer is plated with the diameter of the first opening 25*a* set to 270 mm and with the diameter of the second opening 30*a* set to 276 mm (hereinafter this condition will be referred to as condition C), since the diameter of the first opening 25*a* is larger under condition C than under condition A, the film thickness in the central portion of the substrate is smaller. Also, when the substrate W with a thick seed layer is plated with the diameter of the first opening 25*a* set to 270 mm and with the diameter of the second opening 30*a* set to 278 mm (hereinafter this condition will be referred to as condition B), since the diameter of the second opening 30*a* is larger under condition B than under condition C, the film thicknesses on the periphery of the substrate is larger.

When the substrate W with a thin seed layer is plated with the diameter of the first opening 25*a* set to 270 mm and with the diameter of the second opening 30*a* set to 276 mm (hereinafter this condition will be referred to as condition E), the film thickness in the central portion of the substrate is small and the film thicknesses on the periphery of the substrate is large. This means that the film thickness on the periphery of the substrate has been increased under the influence of the terminal effect. In contrast, when the substrate W with a thin seed layer is plated with the diameter of the first opening 25*a* set to 220 mm and with the diameter of the second opening 30*a* set to 276 mm (hereinafter this condition will be referred to as condition F), since the diameter of the first opening 25*a* is smaller under condition F than under condition E, the film thickness in the central portion of the substrate is larger. Also, when the substrate W with a thin seed layer is plated with the diameter of the first opening 25*a* set to 220 mm and with the diameter of the second opening 30*a* set to 274 mm (hereinafter this condition will be referred to as condition D), since the diameter of the second opening 30*a* is smaller under condition D than under condition F, the film thicknesses on the periphery of the substrate is smaller.

As shown in FIG. 7, even in the case of the substrates W with a thin seed layer on which the influence of the terminal effect appears comparatively prominently, if the diameter of the first opening 25*a* is set smaller than the diameter (270 mm: conditions B and C) of the first opening 25*a* suitable for plating of the substrates W with a thick seed layer, it is possible to curb the reduction in the in-plane uniformity of film thickness on the substrates W due to the terminal effect (see conditions D and F). Furthermore, by adjusting the diameter of the second opening 30*a* in the regulation plate 30, the film thickness on the periphery of the substrate W can be adjusted, making it possible to further curb the reduction in the in-plane uniformity of film thickness on the substrates W due to the terminal effect (see condition D).

FIG. 8 is a diagram showing profiles of plating films on substrates W plated in a plating solution (type A) having a comparatively high electrical resistance and substrates W plated in a plating solution (type B) having a comparatively low electrical resistance. Note that both the substrates W plated in a plating solution having a comparatively high electrical resistance and substrates W plated in a plating solution having a comparatively low electrical resistance have a resist aperture ratio of 10% and have a seed layer thickness of 50 nm to 100 nm.

As illustrated in FIG. 8, when the substrate W is plated in a plating solution having a comparatively high electrical resistance with the diameter of the first opening 25*a* set to 230 mm and with the diameter of the second opening 30*a* set to 276 mm (hereinafter this condition will be referred to as condition A), the film thickness in the central portion of the substrate is large and the film thicknesses on the periphery of the substrate is small. In contrast, when the substrate W is plated in a plating solution having a comparatively high electrical resistance with the diameter of the first opening 25*a* set to 260 mm and with the diameter of the second opening 30*a* set to 276 mm (hereinafter this condition will be referred to as condition C), since the diameter of the first opening 25*a* is larger under condition C than under condition A, the film thickness in the central portion of the substrate is smaller. Also, when the substrate W is plated in a plating solution having a comparatively high electrical resistance with the diameter of the first opening 25*a* set to 260 mm and with the diameter of the second opening 30*a* set to 272 mm (hereinafter this condition will be referred to as condition B), since the diameter of the second opening 30*a* is smaller under condition B than under condition C, the film thicknesses on the periphery of the substrate is smaller.

When the substrate W is plated in a plating solution having a comparatively low electrical resistance with the diameter of the first opening 25*a* set to 270 mm and with the diameter of the second opening 30*a* set to 276 mm (hereinafter this condition will be referred to as condition E), the film thickness in the central portion of the substrate is small and the film thicknesses on the periphery of the substrate is large. This means that the film thickness on the periphery of the substrate has been increased under the influence of the terminal effect. In contrast, when the substrate W is plated in a plating solution having a comparatively low electrical resistance with the diameter of the first opening 25*a* set to 220 mm and with the diameter of the second opening 30*a* set to 276 mm (hereinafter this condition will be referred to as condition F), since the diameter of the first opening 25*a* is smaller under condition F than under condition E, the film thickness in the central portion of the substrate is smaller. Also, when the substrate W is plated in a plating solution having a comparatively low electrical resistance with the diameter of the first opening 25*a* set to 220 mm and with the diameter of the second opening 30*a* set to 274 mm (hereinafter this condition will be referred to as condition D), since the diameter of the second opening 30*a* is smaller under condition D than under condition F, the film thicknesses on the periphery of the substrate is smaller.

As shown in FIG. 8, even if the substrates W are plated in a plating solution having a comparatively low electrical resistance, if the diameter of the first opening 25*a* is set smaller than the diameter (260 mm: conditions B and C) of the first opening 25*a* suitable for plating of the substrates W in a plating solution having a comparatively high electrical resistance, it is possible to curb the reduction in the in-plane uniformity of film thickness on the substrates W due to the terminal effect (see conditions D and F). Furthermore, by adjusting the diameter of the second opening 30*a* in the regulation plate 30, the film thickness on the periphery of the substrate W can be adjusted, making it possible to further curb the reduction in the in-plane uniformity of film thickness on the substrates W due to the terminal effect (see condition D).

As shown in FIGS. 6 to 8, in order to perform plating with good uniformity under conditions differing in the influence of the terminal effect, desirably the diameter of the first opening 25*a* in the anode mask 25 has a wide variation range than the diameter of the opening 30*a* in the regulation plate 30. In order to make the diameter of the opening 25*a* in the anode mask 25 adjustable in a wide variation range, a mechanism which uses the aperture blades 27 described above is suitable. Since the anode mask 25 and substrate W are spaced away from each other, even if the opening 25*a* in the anode mask 25 is decreased, an electric flux spreads between the anode mask 25 and substrate W, allowing the film thickness distribution of the plating film to be adjusted in a wide range of the substrate W.

Even if the influence of the terminal effect is excluded, the plating film tends to become thick on the periphery of the substrate W because the electric flux spreading outward between the anode mask 25 and substrate W concentrates on the periphery of the substrate W. Adjustment of plating film thickness in a comparatively narrow region on the periphery of the substrate W such as described above is achieved by the second adjustment mechanism of the regulation plate 30. The regulation plate 30, which is located close to the substrate W, can directly shield electric fields on the peripheral portion of the substrate W and adjust the plating film thickness even by a comparatively small change in an aperture diameter.

An embodiment of the present invention has been described above, but the embodiment described above is intended to facilitate understanding of the present invention and is not meant to limit the present invention. The present invention can be modified and improved without departing from the spirit and scope of the present invention. Needless to say, the present invention includes equivalents thereof. Also, the components described in the appended claims and in the specification may be used in any combination or any of the components may be omitted as long as at least some of the problems described above can be solved or as long as at least some of the advantageous effects described above can be achieved. For example, in the embodiment described above, plural aperture blades 27 are used as a mechanism for adjusting the diameter of the first opening 25*a*, and the elastic tube 32 is used as a mechanism for adjusting the diameter of the second opening 30*a*. However, other adjustment mechanisms may be adopted instead of the plural aperture blades 27 and the elastic tube 32.

REFERENCE SIGNS LIST

10 Plating apparatus
20 Anode holder
21 Anode
25 Anode mask
25*a* First opening
30 Regulation plate
30*a* Second opening
32 Elastic tube
40 Substrate holder
W Substrate

What is claimed is:

1. A plating method comprising:

placing an anode holder in a plating bath, where the anode holder is integrally provided with an anode mask having a first opening adapted to allow passage of an electric current flowing between an anode and a substrate;

placing a substrate holder adapted to hold a first substrate in the plating bath;

placing a regulation plate between the anode mask and the substrate in a state that the regulation plate separates from the substrate holder and the anode holder, where the regulation plate includes a second opening adapted to allow passage of the electric current flowing between the anode and the substrate;

plating the first substrate with a diameter of the first opening adjusted to a first diameter;

placing a substrate holder adapted to hold a second substrate in the plating bath; and plating the second substrate with a diameter of the first opening adjusted to a second diameter smaller than the first diameter.

2. The plating method according to claim 1, wherein:

the first substrate and the second substrate are partially covered with resist; and a resist aperture ratio of the second substrate is lower than a resist aperture ratio of the first substrate.

3. The plating method according to claim 1, wherein a seed layer of the second substrate is thinner than a seed layer of the first substrate.

4. The plating method according to claim 1, wherein a plating solution used in the step of plating the second substrate is lower in electrical resistance than a plating solution used in the step of plating the first substrate.

5. The plating method according to claim 1, further comprising adjusting the diameter of the second opening in the regulation plate.

6. The plating method according to claim 5, wherein the regulation plate includes an elastic body installed along the second opening; and the step of adjusting the diameter of the second opening in the regulation plate includes a step of injecting a fluid into the elastic body or discharging the fluid out of the elastic body.

7. The plating method according to claim 1, wherein the diameter of the first opening of the anode holder is smaller than the diameter of the second opening of the regulation plate.

* * * * *